US005159727A

United States Patent [19]

McCracken

[11] Patent Number: 5,159,727

[45] Date of Patent: Nov. 3, 1992

[54] CHILD CARE BLANKET WITH PILLOW

[76] Inventor: Jacqueline McCracken, 115 Washington Ave., Kingston, N.Y. 12401

[21] Appl. No.: 752,022

[22] Filed: Aug. 29, 1991

[51] Int. Cl.[5] ..... A47G 9/00

[52] U.S. Cl. ..... 5/655; 5/482; 5/485

[58] Field of Search ..... 5/434, 436, 437, 441, 5/482, 431, 417, 420, 484, 655, 922, 502, 500; D6/601

[56] References Cited

U.S. PATENT DOCUMENTS

D. 315,845 4/1991 Lafley ..... 5/434
4,393,520 7/1983 Koch ..... 5/436
4,631,765 12/1986 Casey ..... 5/417
4,886,150 12/1989 Fitzsimmons ..... 5/420

*Primary Examiner*—Alexander Grosz
*Attorney, Agent, or Firm*—Joseph L. Spiegel

[57] ABSTRACT

Child care device includes a pillow mounted on a baby blanket intermediate its ends. The ends of the blanket are providing with mating fastening means, one on one side of the blanket, one on the other. The blanket is wrapped around the baby holder's arm so that the pillow is on the upside and the baby's head rests thereon when the baby is being cradled by the baby holder. When the baby falls asleep it can be transferred to a crib mattress without disturbing it by placing its body on the mattress along with the pillow and removing the arm from beneath the pillow as by sliding it out. In an alternative embodiment, a sleeve mounting the pillow is utilized in lieu of a blanket.

4 Claims, 3 Drawing Sheets

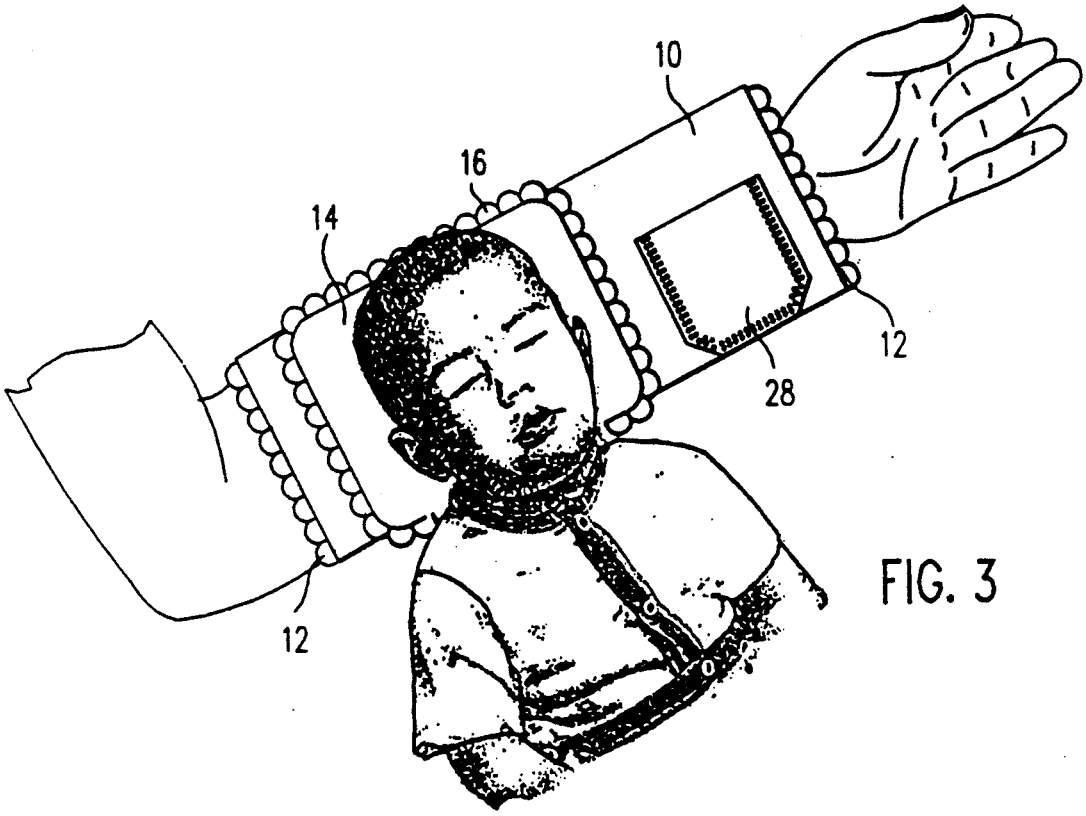
FIG. 3
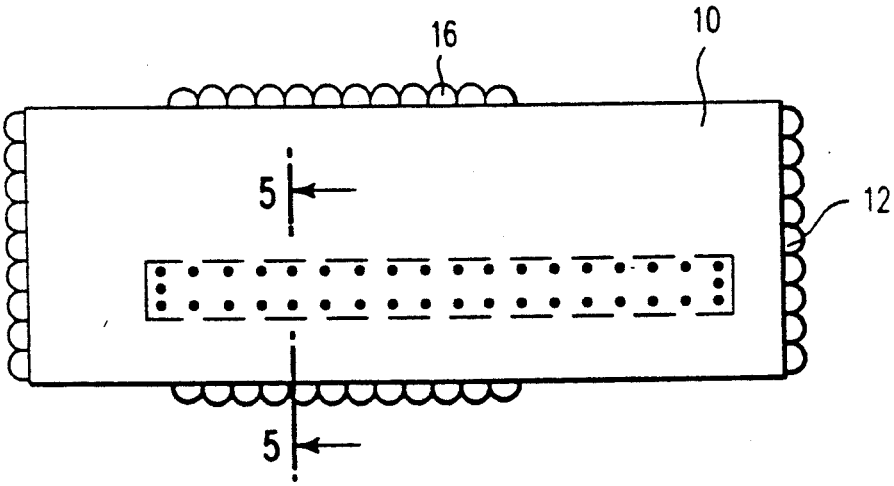
FIG. 4
FIG. 5
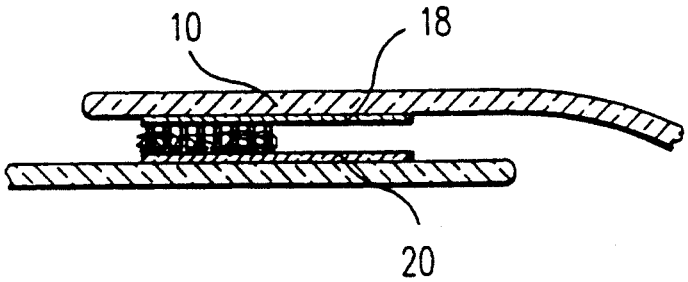

CHILD CARE BLANKET WITH PILLOW

INTRODUCTION

1. Field of the Invention

This invention relates to child care devices, and more particularly to a child care device involving a fabric and a pillow and a fabric fastening arrangement, for the feeding or cuddling of an infant/toddler and the placement with the infant/toddler on a crib mattress without disturbance after the infant/toddler becomes sleepy or falls asleep in a holder's arms.

2. Prior Art

Prior art patents include U.S. Pat. Nos. 2,883,682 (Kwake); 2,898,609 (Storie); 3,296,634 (Rusnak); 3,689,947 (Wolf); 4,068,786 (Taniguchi); 4,097,944 (Yulish); 4,200,942 (Case); 4,227,270 (Rivera); 4,231,125 (Tittl); 4,316,287 (Rule); 4,468,823 (Tounjian); 4,754,512 (Chao-Yang); and 4,991,245 (Franco).

Kwake discloses as a combination beach towel-inflatable pillow.

Storie discloses a combination beach pack including a beach blanket with an inflatable pillow.

Rusnak describes a head rest for strapping to the body of the user. Typically its strapped somewhere around the neck.

Wolf shows a pillow that is removable from a pocket and a blanket or towel arrangement.

Taniguchi describes a shoulder baby bag. Additionally the pouch of the bag can be used as a pillow and a bag flap acts as a blanket. (See FIG. 7.)

Yulish shows a combination pillow/blanket arrangement including pockets for storage of clothing.

Case is another blanket and pillow arrangement.

Rivera discloses a pillow case having a receptacle upon its upper side in which a baby bottle is retained during a time of nursing, and the pillow case upper side includes a sideward extending flap upon which a baby rests its head while sucking on the bottle nipple.

Tittl uses Velcro strips, the velcro being used in one instance to secure the pillow and in another instance to secure the towel to another towel.

Rule discloses a combination pillow/blanket arrangement that can be wrapped around the child as a lounging garment as well.

Tounjian shows a pouch which can be used for holding valuables such as keys, money, etc.

Chao-Yang shows a combination towel/bedding arrangement.

Franco discloses a pillow/blanket combination convertible into a tote-bag.

SUMMARY OF THE INVENTION

It is an object of this invention to provide a child care device that makes the holding or feeding of an infant/-toddler more comfortable, both for the child as well as for the person holding or feeding the same.

It is another object of the invention to provide a child care device that makes the placement of an infant/toddler in a crib after holding or feeding, more comfortable to the child and more convenient to the person who has been holding it.

It is another object of the invention to provide a child care device that is easy of use.

Still another object of the invention is to provide a child care device that is simple of construction and easy of manufacture.

A child care device according to the invention may involve a fabric such as a baby blanket, a pillow, and a fastener arrangement to attach the baby blanket to the arm of a person contemplating holding the infant or toddler to form a sleeve and so that the pillow provides a head rest for the child. To this end the pillow is attached to an intermediate portion of the blanket through suitable means.

The fastener arrangement includes portions on the ends of the blanket which are engaged to hold the blanket in place once it is wrapped around a potential baby holder's arm. Thus the fastener arrangement portions are preferrably repectively of the male and female type and easily fastened together and separated apart. The fastener arrangement, however, may also be permanent stiches holding the fabric in a tubular shape so that it is always ready to be placed onto the arm. Or the fabric may be formed in a tubular shape so that the fastener arrangement is integral therewith.

The pillow is preferably removable from the blanket to facilitate cleaning one or the other as may be necessitated.

The blanket will be placed on the arm so that the pillow is on the upper side of the arm and the child being cradled can rest his head on the pillow.

When the child has fallen asleep, the child may be placed in a crib with his head resting on the pillow. The arm is then removed from the blanket sleeve by grasping the far side of the blanket with the now free hand of the other arm and pulling the first arm out from within the blanket.

Of course the blanket can be readily used as a blanket. If a removable pillow is involved, the blanket will seem as a normal blanket, function-wise.

BRIEF DESCRIPTION OF THE DRAWINGS

These and other objects, features, and advantages of the invention will become apparent from a reading of the following description of a preferred embodiment of the invention when considered with the appended drawings wherein:

FIG. 3 is a plan view of the child care device showing the blanket sleeve installed on a person's arm with the pillow up and the child resting his head on the pillow of the device, the arm being extended preparatory to placing the child with his head on the pillow undisturbed on a crib mattress;

FIG. 4 is bottom view of the device of FIG. 3 and showing the Velcro fastening arrangement;

FIG. 5 is a view of the Velcro fastening means taken along the section line 5—5 of FIG. 4;

DETAILED DESCRIPTION OF PREFERRED EMBODIMENTS OF THE INVENTION

Referring more particularly to the embodiment of FIGS. 1–5, the child care device is shown as embodying a blanket 10 having fringes or fancy edges 12. A pillow 14 having a fringe or fancy edge 16 is secured to the middle of the blanket. The securing may be by sewing or by snaps or Velcro or may be by means of a pillow case permanently secured to the blanket as by sewing and in which the pillow 14 is inserted in use of the blanket as the child care device being contemplated.

Figure 1:
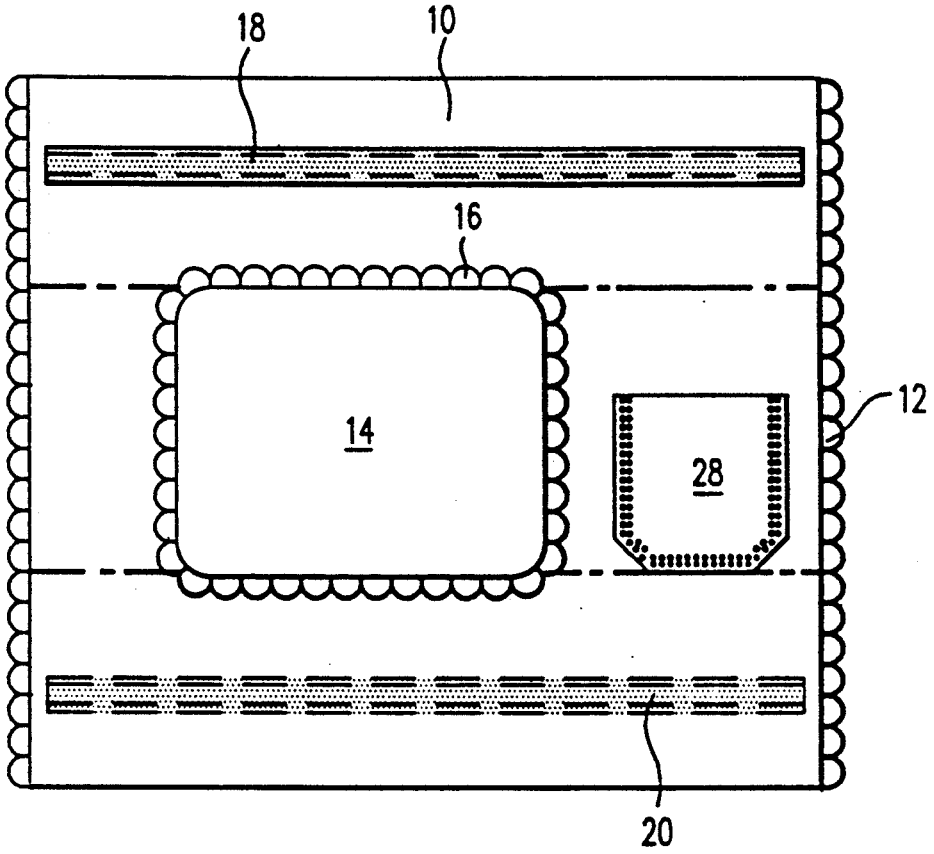
FIG. 1 is a plan view of the child care device according to the invention employing Velcro as a fastening arrangement.

As shown in FIGS. 1, 4 and 5, the fastening arrangement for holding the blanket about the child holder's arm may be a Velcro fastening arrangement. Velcro is a trade name for a fastening arrangement involving a "male" and a cooperating "female" fastening portion or member. The male fastening member 18, shown in FIG. 1 as on the side upper end of the blanket 10, is attached extending substantially across the entire lateral width of the blanket 10 and has numerous rows of hook-like projections extending outwardly from its base. The female fastening member 20 too is attached extending substantially across the entire lateral width of the blanket 10 but is mounted on the underside of the lower end of the blanket as seen in FIG. 1, and includes a loose, fibrous, non-woven material adapted to receive the hook-like projections of the male member in easily releasable fashion on perpendicular movement of the member while resisting dislocation from lateral stresses.

As shown in FIGS. 3–5, the blanket is wrapped around an arm so that the pillow 14 is on the upper-most side of the arm for receiving the head of the child being cradled. The blanket would be secured in place by the hook-like members of the Velcro fastening member 18 being received in the loose, fibrous, nonwoven material of the Velcro female fastening member 20 as best seen in FIG. 5.

While FIG. 3 shows the blanket on an outstretched arm, it will be appreciated that the blanket is of flexible material such that the arm may be cradled to properly receive a child's head on the pillow 14. After the child has been fed and/or has fallen asleep, the child with the blanket and its wraped arm would be placed on a crib mattress. The hand on the free arm would then be used to grasp the outer end of the blanket as seen in FIG. 3, and the arm would then be withdrawn from the blanket sleeve. Thus the child would be left relatively undisturbed and free to continue his sleep.

Figure 2:
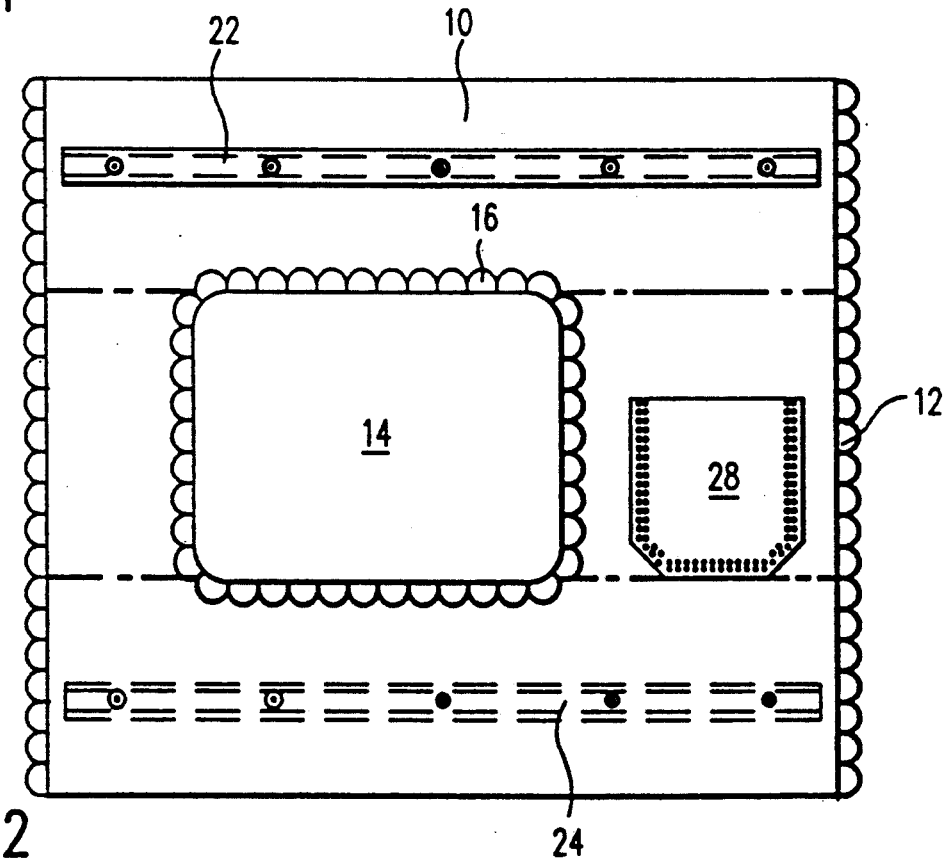
FIG. 2 is another plan view of the child care device but employing male and female snaps as the fastening arrangement.

FIG. 2 shows a child care device embodying snap fastening means instead of Velcro fastening means. A strip 22 of male snap members may be secured as the fastening means provided on the upper end side of the blanket. A strip 24 of female snap fastening means may be provided on the lower end, lower side of the blanket. The snap fastening means would be secured to each other in the manner akin to the Velcro fastening means of FIG. 1.

Figure 6:
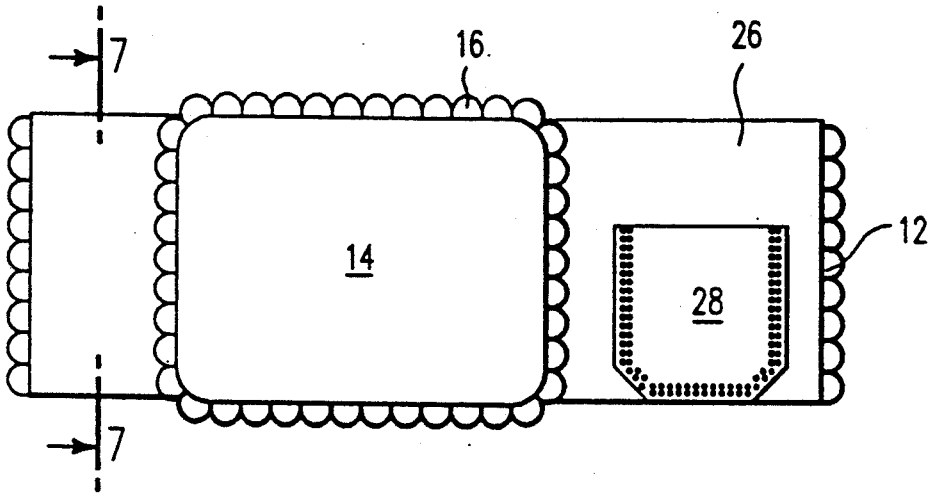
FIG. 6 is a plan view of another embodiment of the invention wherein a permanent sleeve is employed instead of a sleeve formed by a blanket and fastener arrangement, to hold a pillow in place on an arm.
Figure 7:
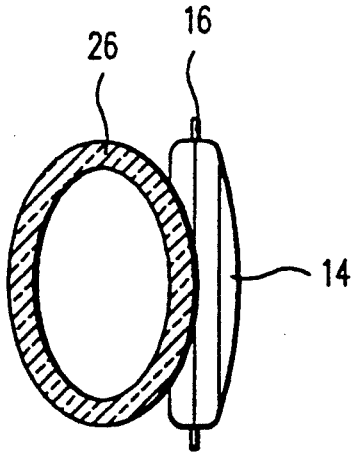
FIG. 7 is a view taken along the section line 7—7 of FIG. 6 and rotated clockwise 90 degrees.

FIGS. 6 and 7 show another embodiment of the invention. As best seen in FIG. 7 instead of a blanket having its ends secured by separable fastening means, a sleeve 26 is formed of a cylinder of material which is large enough to receive the arm. The arm would be inserted in the sleeve such that the pillow 14 would rest on the upper side of the arm as the child is cradled. Again the arm would be withdrawn from the sleeve 26 after the sleeping child and the sleeve and pillow had been placed upon a mattress.

A patch pocket 28 may be sewn on the blanket or sleeve to provide a holder for accessories normally involved in child care.

It would be appreciated that applicant has provided a new child care device and which solves a problem encountered by mothers in transferring a child which has been cuddled to sleep onto a mattress to continue his nap. Applicant's device enables this transfer to be made with a minimum of disturbing influence upon the child.

The embodiment show alternative means for achieving the desirable result.

It will also be appreciated that various details of the invention as set forth above maybe changed without departing from the scope of the invention. Also that persons skilled in the art can embody principles of the invention in other and different embodiments. The foregoing description of preferred embodiments is for illustrative purposes only and not for purposes of limitation. It is intended to be limited only by the scope or spirit of the appended claims.

What is claimed is:

1. A child care device including a blanket, means for mounting a pillow on said blanket substantially inwardly from the periphery of the blanket, and cooperating separable fastener means on spaced portions of the blanket adapted to releasably secure the blanket around a human arm while keeping the pillow exposed to support a baby's head.

2. A device according to claim 1, wherein the blanket is adapted to be secured around a human arm in a loose fitting manner.

3. A device according to claim 1, wherein the blanket includes a pocket adapted to hold accessories involved in child care.

4. A device according to claim 1, wherein the separable fastener means comprise hook and loop type fasteners.

* * * * *